US007201597B2

(12) United States Patent
Hong et al.

(10) Patent No.: US 7,201,597 B2
(45) Date of Patent: Apr. 10, 2007

(54) CONNECTOR ASSEMBLY STRUCTURE OF A TERMINAL

(75) Inventors: Alex Hong, Kaohsiung (TW); Chia Ching Tsai, Kaohsiung (TW)

(73) Assignee: Sunonwealth Electric Machine Industry Co., Ltd. (TW)

( * ) Notice: Subject to any disclaimer, the term of this patent is extended or adjusted under 35 U.S.C. 154(b) by 0 days.

(21) Appl. No.: 11/222,751

(22) Filed: Sep. 12, 2005

(65) Prior Publication Data

US 2006/0160397 A1 Jul. 20, 2006

(30) Foreign Application Priority Data

Jan. 17, 2005 (TW) ..... 94101331 A

(51) Int. Cl.
*H01R 13/627* (2006.01)

(52) U.S. Cl. ..... 439/352

(58) Field of Classification Search ..... 439/350–353
See application file for complete search history.

(56) References Cited

U.S. PATENT DOCUMENTS 4,086,579 A * 4/1978 Easter ..... 345/20
6,383,003 B1 * 5/2002 Corona ..... 439/278

* cited by examiner

*Primary Examiner*—Truc T. Nguyen
(74) *Attorney, Agent, or Firm*—Bacon & Thomas PLLC

(57) ABSTRACT

The present invention relates to a connector assembly structure of a terminal used for converting connecting wires. A terminal base is disposed on a frame of a cooling system, and the terminal base has a socket into which a first connector is inserted. The first connector is connected to the connecting wires that are connected to a stator of a motor, and has at least one hook on the periphery thereof. The socket has a releasing hole that corresponds to the hook and engages with the hook so that the first connector is detachable. Additionally, a second connector is adjacent to the first connector, and is connected to the connecting wires to be converted. The electrically interconnection between the first connector and the second connector can satisfy the requirement of converting various connecting wires.

6 Claims, 5 Drawing Sheets

CONNECTOR ASSEMBLY STRUCTURE OF A TERMINAL

FIELD OF THE INVENTION

The present invention is related to a connector assembly structure of a terminal used for converting connecting wires, which is applied to the converting terminals of various cooling system, and can achieve the requirement of converting various connecting wires by the design of the terminal structure of the standard connectors.

DESCRIPTION OF THE RELATED ART

The diameters of the connecting wires of the cooling systems vary with the electrical resistance of the connecting wires. For example, a connecting wire with a specification of UL 1015 18AWG corresponds to a diameter of 2.80 mm, and a connecting wire with a specification of UL 1015 22AWG corresponds to a diameter of 2.40 mm. However, it is consuming that the frames of the cooling systems are produced by different specifications in order to fit different diameters of the connecting wires. Therefore, in order to satisfy the market demand of the connecting wires with different diameters, a terminal structure for standard connectors is designed to achieve the requirement of converting various connecting wires.

FIG. 1 shows a schematic diagram of a conventional terminal structure of connecting wires. The conventional terminal structure of connecting wires is disposed on the frame 10 of a cooling system. The frame 10 is hollow and has a motor base 11 on the central portion thereof. A motor stator and a motor rotor are mounted on the motor base 11. Further, the motor base 11 is connected to the frame 10 through a plurality of ribs 12, wherein at least one rib 12 has a wire groove 13 through which the connecting wires of the motor stator extend out to connect to a first connector 21 of the frame 10. The first connector 21 has two connecting pins 211 disposed thereon.

Additionally, the conventional terminal structure further has a second connector 22 that is connected to the connecting wires to be converted. The second connector 22 has two receiving holes 221 in which the connecting pins 211 of the first connector 21 insert and affix. The interconnection and coupling of the connecting pins 211 and the receiving holes 221 between the first connector 21 and the second connector 22 can achieve the objective of electrically connecting and converting various connecting wires.

However, the conventional terminal structure has the following disadvantages:

1. It is difficult to detach the first connector 21. In the conventional terminal structure, the first connector 21 is affixed on the frame 10. Once the first connector 21 is attached to the frame, it is very difficult to be detached. When it needs to overhaul or confirm the connection between the first connector 21 and the connecting wires, the difficulty of detaching the first connector 21 will cause the difficulty of overhauling.

2. The second connector 22 will unfasten from the first connector 21 easily. The first connector 21 and the second connector 22 interconnect by the coupling of the connecting pins 211 and the receiving holes 221, and are connected by the friction therebetween. Moreover, the cooling system generates high frequency vibration during operation. Therefore, the second connector 22 will unfasten from the first connector 21 easily.

Consequently, there is a need for improved connector assembly structure of a terminal to solve the above-mentioned problems that it is difficult to detach the first connector 21 and the second connector 22 will unfasten from the first connector 21 easily.

SUMMARY OF THE INVENTION

The main object of the present invention is to provide a connector assembly structure of a terminal used for converting connecting wires. A terminal base is disposed on a frame of a cooling system, and the terminal base has a socket into which a terminal is inserted. The terminal comprises a first connector and a second connector. The first connector is connected to the connecting wires that are connected to a stator of a motor, and has at least one hook on the periphery thereof. The socket has a releasing hole that corresponds to the hook and engages with the hook so that the first connector is detachable.

Additionally, the second connector is connected to the connecting wires to be converted. The electrically interconnection between the first connector and the second connector can satisfy the requirement of converting various connecting wires.

DETAILED DESCRIPTION OF THE INVENTION

The present invention is related to a connector assembly structure of a terminal used for converting connecting wires, which is applied on the frames of various cooling systems. Several embodiments for illustrating the relative positions of all elements of the present invention are described as follows.

Figure 1:
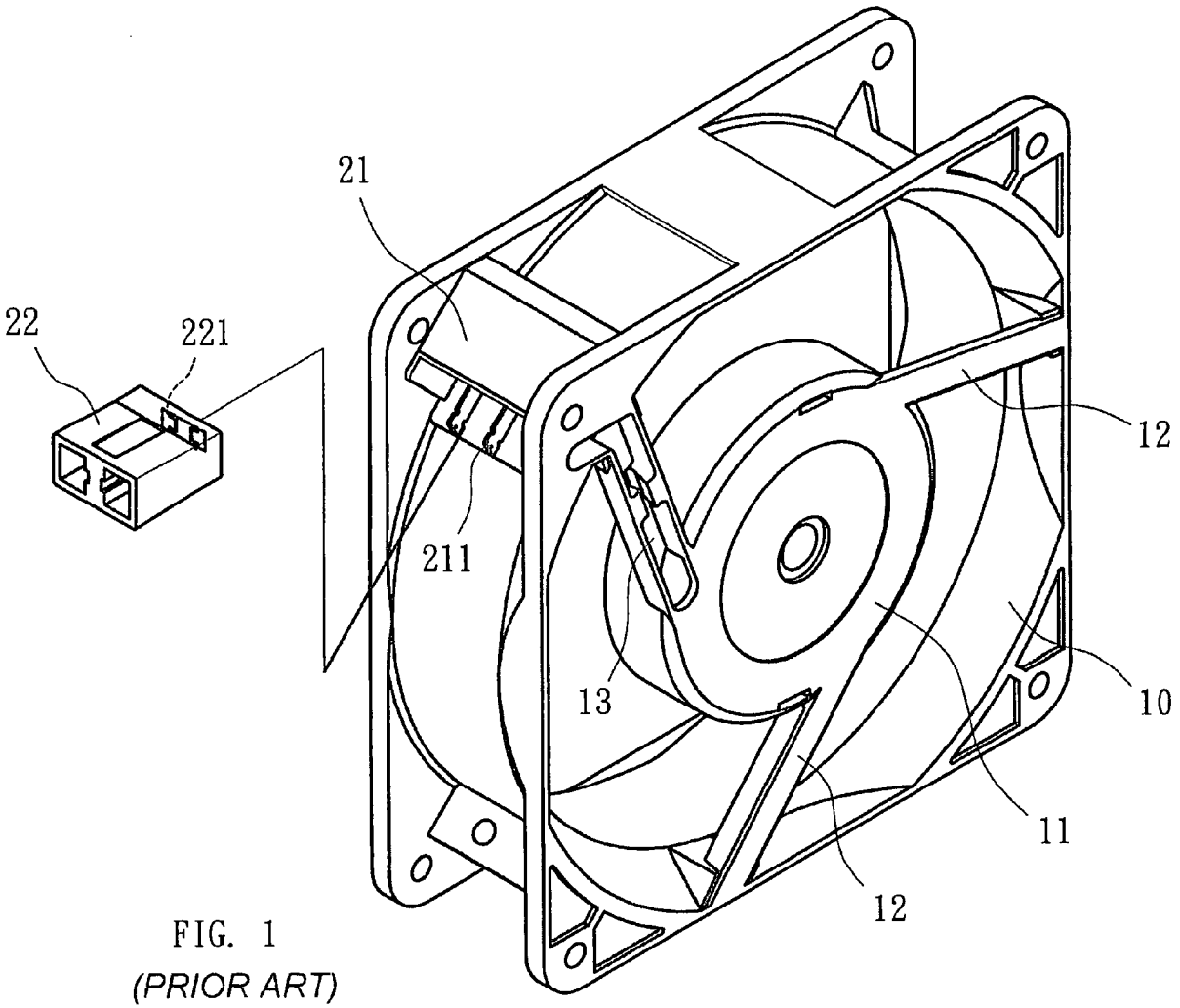
FIG. 1 (PRIOR ART)
FIG. 1 shows a schematic diagram of a conventional terminal structure of connecting wires.
Figure 2:
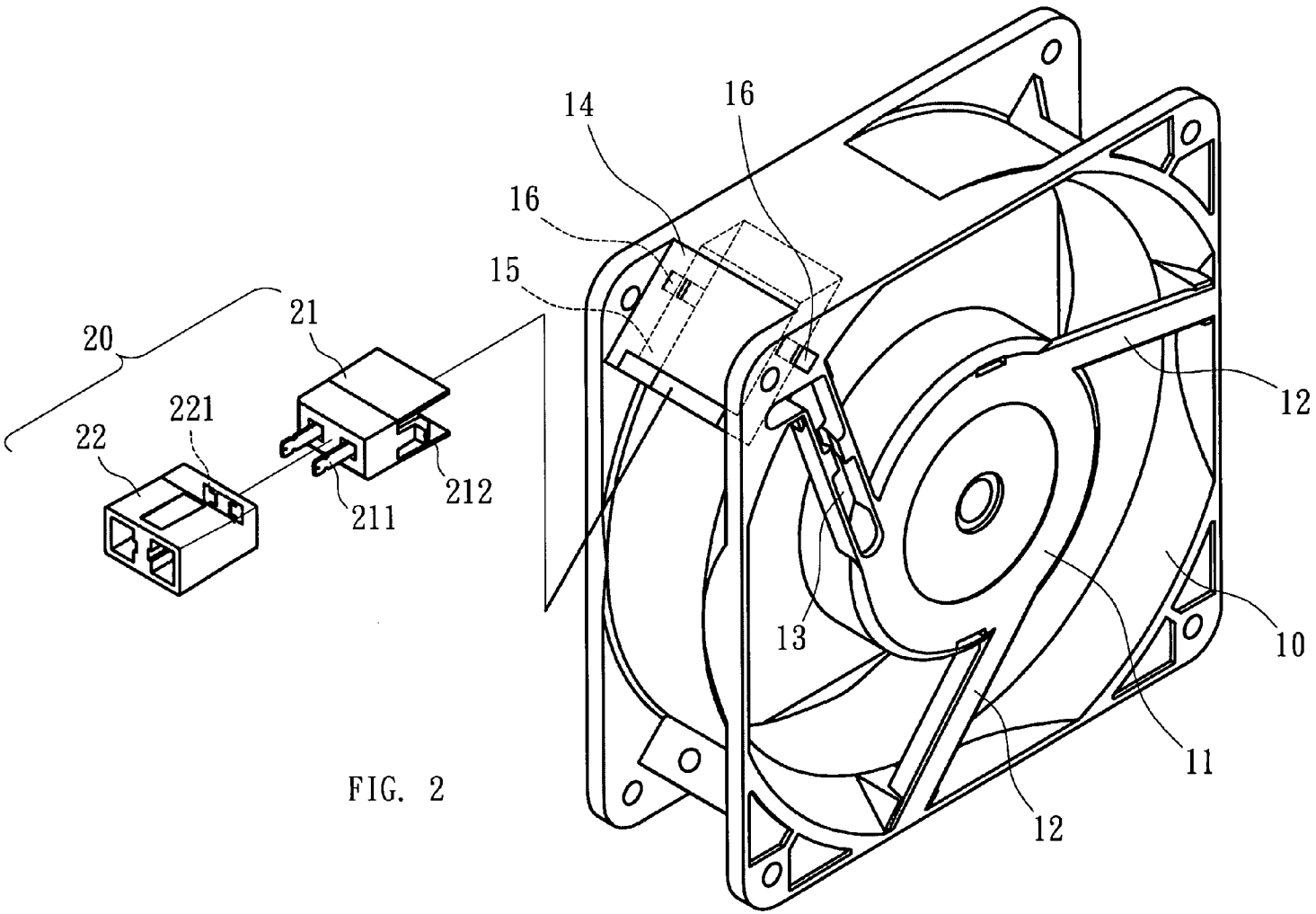
FIG. 2 shows a perspective and exposed view of a terminal structure according to a first embodiment of the present invention.

Referring to FIG. 2, the frame 10 is hollow and has a motor base 11 on the central portion thereof. A motor stator and a motor rotor are mounted on the motor base 11. Further, the motor base 11 is connected to the frame 10 through a plurality of ribs 12, wherein at least one rib 12 has a wire groove 13 through which the connecting wires of the motor stator extend out. A terminal base 14 is disposed on the position where the wire groove 13 connects to the frame 10. The terminal base 14 has a socket 15 into which a terminal 20 is inserted.

Figure 3:
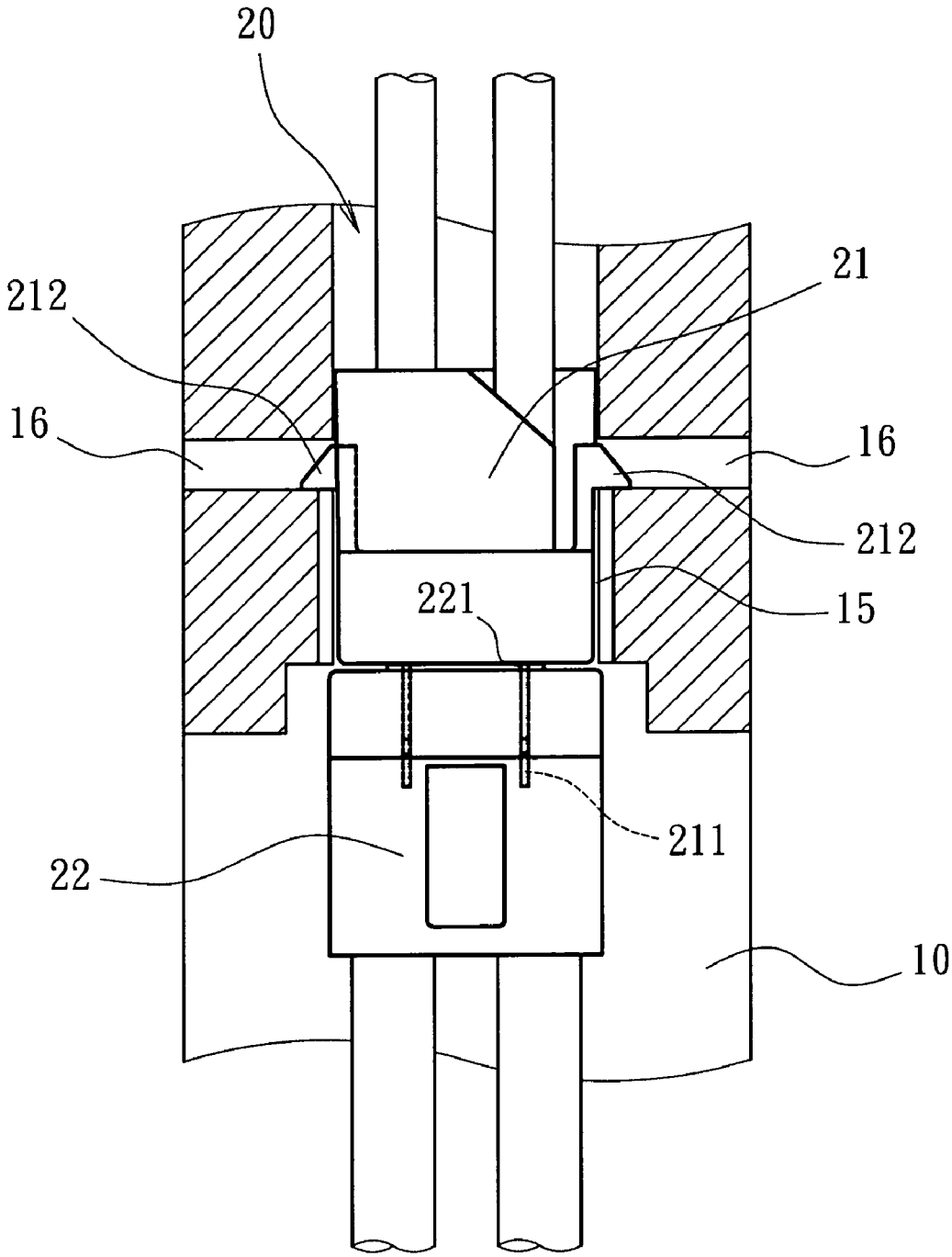
FIG. 3 shows an assembly and cross-sectional view of a terminal structure according to a first embodiment of the present invention.

Referring to FIGS. 2 and 3, the terminal 20 comprises a first connector 21 and a second connector 22. The first connector 21 is connected to the connecting wires that are connected to a stator of a motor, and has two connecting pins 211 on one end thereof. The second connector 22 is connected to the connecting wires to be converted, and has two receiving holes 221 corresponding to the connecting pins 211 of the first connector 21. The electrical interconnection and coupling of the connecting pins 211 and the receiving holes 221 can achieve the objective of converting various connecting wires.

The first connector 21 has two hooks 212 on two sides thereof, and is disposed into the socket 15. The socket 15 has two releasing holes 16 that correspond to the hooks 212. The releasing holes 16 are engaged with the hooks 212 so that the first connector is detachable. Preferably, the releasing holes 16 extend through the frame 10.

To detach the first connector 21, a strip is utilized to urge against the hooks 212 through the releasing holes 16 so that the hooks 212 can unfasten from the releasing holes 16. Thus, the first connector 21 can be detached.

Figure 4:
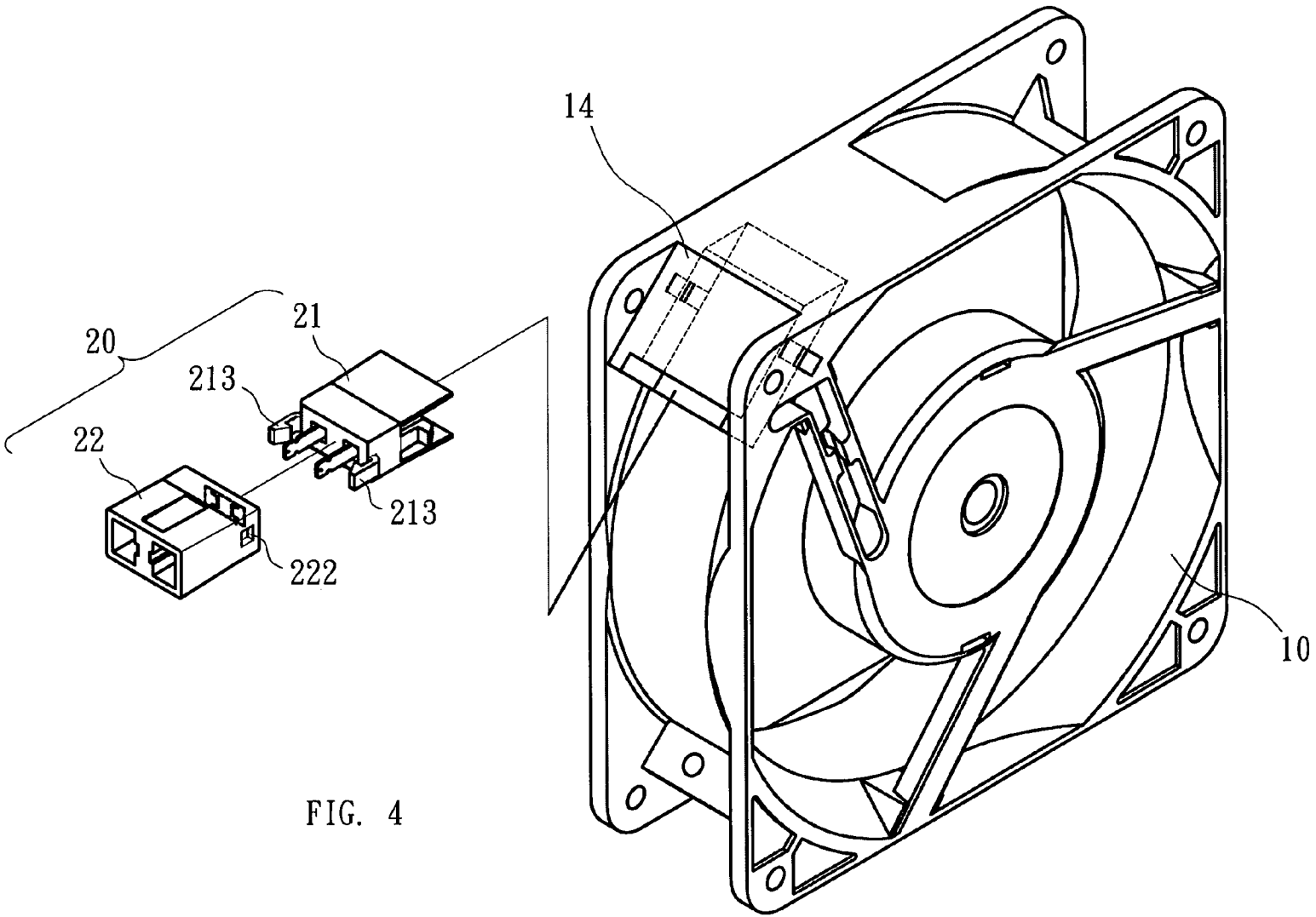
FIG. 4 shows a perspective and exposed view of a terminal structure according to a second embodiment of the present invention.

FIG. 4 shows another embodiment of the terminal 20. Similarly, the terminal 20 comprises a first connector 21 and a second connector 22. The first connector 21 is disposed in the terminal base 14 of the frame 10, and has two protrusions 213 on the periphery thereof. The protrusions 213 may be disposed on two sides of the first connector 21, or on the top side with relative large area of the first connector 21 (FIG. 4 only shows that the protrusions 213 are disposed on two sides of the first connector 21). The second connector 22 has two positioning holes 222 corresponding to the protrusions 213. The first connector 21 and the second connector 22 not only have the connecting pins and receiving holes therebetween for electrical interconnecting but also have the protrusions 213 and the positioning holes 222 therebetween for interlocking.

Figure 5:
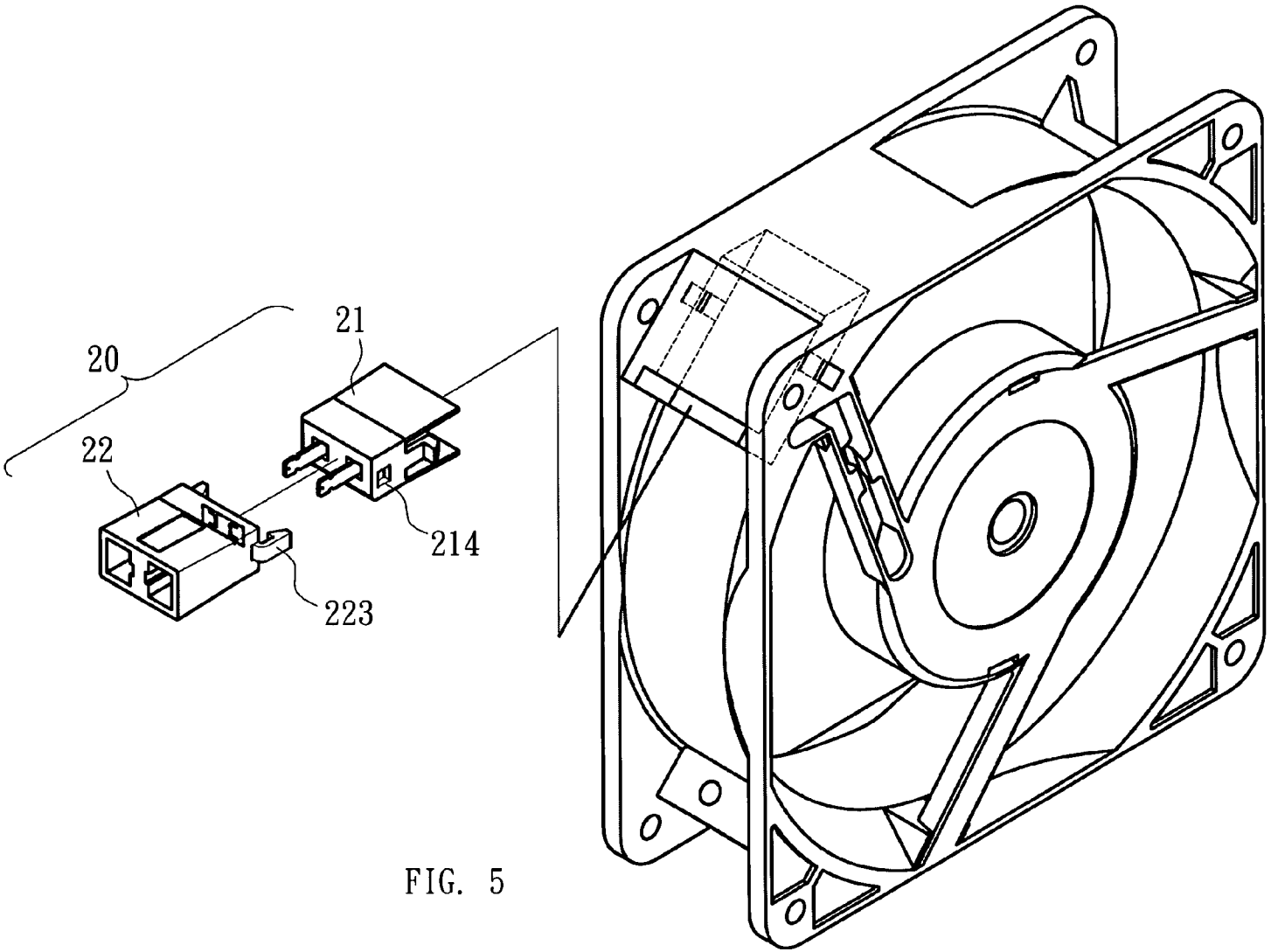
FIG. 5 shows a perspective and exposed view of a terminal structure according to a third embodiment of the present invention.

FIG. 5 shows a third embodiment of the terminal 20. Similarly, the terminal 20 comprises a first connector 21 and a second connector 22. The difference between the third embodiment and the second embodiment of FIG. 4 is that the protrusions 223 are disposed on the second connector 22. The protrusions 223 may be disposed on two sides of the second connector 22, or on the top side with relative large area of the second connector 22. The first connector 21 has two positioning holes 214 corresponding to the protrusions 223. The interlocking between the protrusions 223 and the positioning holes 214 secures the first connector 21 and the second connector 22.

In conclusion, the first connector has hooks and releasing holes so that the first connector has an advantage of being assembled and detached fast. Moreover, the design of the protrusions and the positioning holes secures the first connector and the second connector which will not unfasten even under high frequency vibration for a long time. Accordingly, the disadvantages of the conventional terminal structure are solved thoroughly.

From the invention thus described, it will be obvious that this invention as described above is provided for explanation and that the invention may be varied in many ways, where such variations are not to be regarded as departing from the spirit and scope of the invention, and all such modifications as would be obvious to one skilled in the art are intended for inclusion within the scope of the following claims.

What is claimed is:

1. A connector assembly structure of a terminal used for converting connecting wires, comprising a first connector disposed on a frame of a cooling system, wherein the first connector is connected to the connecting wires that are connected to a stator of a motor of the cooling system, and has at least one hook on the periphery thereof, and the cooling system has a releasing hole that corresponds to the hook and engages with the hook;

wherein the frame has a terminal base disposed thereon, and the terminal base has a socket into which the first connector is inserted; and wherein the first connector is configured for connection with a second connector.

2. The connector assembly structure of a terminal of claim 1, further comprising a second connector adjacent to the first connector, wherein the second connector is connected to the connecting wires to be converted, and the first connector and the second connector have at least one connecting pin and at least one receiving hole therebetween for coupling and interconnecting.

3. The connector assembly structure of a terminal of claim 1, wherein the frame is hollow and has a motor base on the central portion thereof, a motor stator and a motor rotor are mounted on the motor base, the motor base is connected to the frame through a plurality of ribs, wherein at least one rib has a wire groove through which the connecting wires of the motor stator extend out.

4. The connector assembly structure of a terminal of claim 2, wherein the first connector and the second connector have at least one protrusions and at least one positioning hole therebetween for interlocking.

5. The connector assembly structure of a terminal of claim 4, wherein the protrusion and the positioning hole are disposed on the sides of the first connector and the second connector, respectively.

6. The connector assembly structure of a terminal of claim 4, wherein the protrusion and the positioning hole are disposed on the top side with relative large area of the first connector and the second connector, respectively.

* * * * *